US008118196B2

(12) United States Patent
De Man et al.

(10) Patent No.: US 8,118,196 B2
(45) Date of Patent: Feb. 21, 2012

(54) CARTRIDGE PISTOL WITH A CARTRIDGE HOLDER

(75) Inventors: Eelco H. De Man, Vlijmen (NL); Roy Van Swieten, Hedel (NL)

(73) Assignee: Ray Technology Group B.V., Ravenstein (NL)

( * ) Notice: Subject to any disclaimer, the term of this patent is extended or adjusted under 35 U.S.C. 154(b) by 844 days.

(21) Appl. No.: 10/599,814

(22) PCT Filed: Apr. 6, 2005

(86) PCT No.: PCT/IB2005/000947

§ 371 (c)(1), (2), (4) Date: Oct. 1, 2008

(87) PCT Pub. No.: WO2005/097354

PCT Pub. Date: Oct. 20, 2005

(65) Prior Publication Data

US 2009/0218372 A1 Sep. 3, 2009

(30) Foreign Application Priority Data

Apr. 8, 2004 (CH) ..... 0619/04

(51) Int. Cl.
*B05C 17/01* (2006.01)

(52) U.S. Cl. ..... 222/391; 222/327

(58) Field of Classification Search ..... 222/325–327, 222/386, 391

See application file for complete search history.

(56) References Cited

U.S. PATENT DOCUMENTS 3,215,320 A * 11/1965 Heisler et al. ..... 222/391
4,838,461 A * 6/1989 Santerelli ..... 222/259

* cited by examiner

*Primary Examiner* — J. Casimer Jacyna
(74) *Attorney, Agent, or Firm* — Janet Sleath; Speckman Law Group PLLC

(57) ABSTRACT

A cartridge gun is provided. The cartridge gun comprises a cartridge holder, a plurality of resilient gripping elements, a displaceable piston rod for moving a piston in a cartridge, and an actuating device for displacing the piston rod. The cartridge holder comprises a cylindrical base for receiving the floor region of the cartridge in which the gripping elements project radially outwardly from the center of the cartridge holder in the direction towards the housing into an annular groove of the base up to the outside wall of the annular groove in the base and are held in the center of the base by means of a hub. Means are further arranged at the front end of the piston rod which are designated to press the ends of the resilient gripping elements in the direction towards the housing when the piston rod is fully retracted, allowing the removal of the cartridge from the cartridge gun.

12 Claims, 4 Drawing Sheets

CARTRIDGE PISTOL WITH A CARTRIDGE HOLDER

CROSS REFERENCE TO RELATED APPLICATIONS

This application claims priority under 35 U.S.C. §365(a) to International Patent Application No. PCT/IB2005/000947, filed Apr. 6, 2005, and under 35 U.S.C. §120 to International Patent Application No. PCT/IB2005/000947, filed Apr. 6, 2005, which claims priority to Swiss Patent Application No. 00619/04, filed Apr. 8, 2004.

FIELD OF THE INVENTION

The invention generally relates to a cartridge gun with a cartridge holder.

BACKGROUND OF THE INVENTION

Cartridge guns, also known as cartridge presses, are known in the art, and may be used for pressing out pasty materials from cartridges, e.g. sealing materials, adhesive materials, and the like. In general, these cartridge presses comprise a shell for receiving a cartridge wherein the shape of the shell matches the external shape of the cartridge. One side of the shell is fastened to the handle of the cartridge press and comprises a recess in which a pressure rod with the stamp attached thereto is displaceable. The opposite side of the cartridge press is slotted, so that the tip of the cartridge which comprises a displaceable floor acting as a piston can be placed in said slot. The pressure rod, comprising an actuating member in the form of a swivelable trigger lever, can be pushed forward by a gun-like actuating or triggering mechanism. The pressure rod is moved a short step forward during each triggering movement. The actuating mechanism comprises an advancing element which is pushed forward by the manual movement of the actuating member and entrains the pressure rod. When the actuating member is released, the advancing element slides back onto the pressure rod.

A major disadvantage in the above-described cartridge presses is their overall size, resulting in added weight of the cartridge presses. The cartridge holder is generally made of sheet metal or the like, which results in a relatively high consumption of material. Approximately half the material required for such cartridge presses is used for the construction of the cartridge holder, which has an effect on the overall weight of the cartridge gun. A reduction of the share of material of the cartridge holder and a reduction in the weight is therefore desirable. A further disadvantage of these cartridge holders is that the insertion and removal of the cartridges is cumbersome because they frequently jam.

DE G89 01 028.0 discloses a hand press gun, in which a screw cap with an inside thread is attached to the face side of a gun grip, into which a threaded ring with an external thread and axial bore is screwed. The cartridge, comprising a flange at the rear end, is pushed from behind through the threaded ring until the flange abuts on the rear side of the threaded ring, and the threaded ring is screwed into the screw cap.

EP-A2-1 034 847 discloses a cartridge press with a cartridge holder comprising claws having free ends which engage in the outside wall of a cartridge pushed into the holder. The claws dig slightly into the material of the cartridge, so that the cartridge is held in a secure manner. A displaceable sleeve is pressed against the cartridge holder and against the claws for removing the cartridge from the cartridge holder, as a result, the cartridge can be pulled from the cartridge holder.

The above-mentioned hand press gun and cartridge press have the disadvantage in that the exchange of cartridges is cumbersome and time-consuming. A threaded ring or a sleeve needs to be unscrewed first or actuated before the cartridge can be removed from the cartridge holder. This manipulation is cumbersome because the process requires three actions: holding the gun, unscrewing the threaded ring and pressing the cartridge against the claws, and removing the empty cartridge from the cartridge gun.

SUMMARY OF THE INVENTION

A cartridge gun comprising a cartridge holder is provided. The inventive cartridge gun requires little material and allows a simple exchange of cartridges. The cartridge gun comprises a piston rod and a base in which the lower end of a cartridge is insertable. Gripping elements are arranged in the base which engage the inside wall of the inserted cartridge and hold the cartridge. To release the gripping elements, the piston rod is withdrawn completely from the cartridge until a stamp arranged at the front end of the piston rod presses back the gripping elements from the gripping position and releases the cartridge for removal. The advantage of such a cartridge gun is that the cartridge receiver, comprising a base, does not extend over the entire length of the cartridge to be inserted therein. Material is saved by omitting a shell construction for the cartridge holder. The overall weight of the cartridge gun can thus be kept low. The cartridge gun further comprises an actuating device for displacing the piston rod, which allows the displacement of the piston rod in a continuous manner, alternating in the forward direction or in the reverse direction. A stamp, comprising a rearward projecting stamp, is arranged at the front end of the piston rod. To remove a used or empty cartridge, the stamp is retracted with the piston rod until the edge of the stamp rests on the gripping elements arranged in the base of the cartridge holder. The retraction of the stamp can be achieved either by pulling at the rear end of the piston rod or by multiple pressing of a retraction lever, which displaces the piston rod in a rearward direction. By pressing the retraction lever, the stamp presses against the gripping elements and detaches the gripping elements from their anchoring in the cartridge wall. The cartridge can thus be removed without any obstructions from the cartridge holder. The removal of a used or empty cartridge from the inventive cartridge gun is thus substantially simplified, when compares to cartridges guns or presses known in the art.

A further advantage of the inventive cartridge gun is that the actuating device allows a displacement of the piston rod in a continuous manner in the forward and rearward direction. One problem with conventional cartridge guns or presses is that a pressure builds up within the cartridge during the advancement of the stamp, which is attached to the piston rod. After the emission of the pasty material within the cartridge, a subsequent dripping of the pasty material within the cartridge usually occurs due to the release of the pressure within the cartridge, thus achieving precise dosing and apportioning of the pasty material is difficult. The subsequent dripping of the pasty material can soil the ambient environment. The pressure build-up within the cartridge which causes the subsequent dripping is caused by the fact that the medium to be pressed out from the cartridge comprises a certain compressibility and also by a certain elastic deformability of the cartridge. Subsequent dripping can be avoided when the pressure within the cartridge is reduced. This reduction of pressure can be achieved by withdrawal of the stamp before the pressure begins to build up within the cartridge. Once sufficient pasty material has been released from the cartridge attached to the inventive cartridge gun, the retraction lever is pressed slightly, resulting in the stamp being slightly withdrawn, and the force from the stamp cease to act on the piston.

BRIEF DESCRIPTION OF THE DRAWINGS

The present invention will be described in greater detail in the following detailed description, with reference to the accompanying drawings, wherein.

DETAILED DESCRIPTION OF THE INVENTION

A cartridge gun comprising a cartridge holder is provided. The inventive cartridge gun has the advantages of weighing lighter than cartridge guns or presses known in the art and being able to substantially eliminate the subsequent dripping of materials released from the cartridge due to the pressure build-up within the cartridge when the cartridge is pressed.

Figure 1:
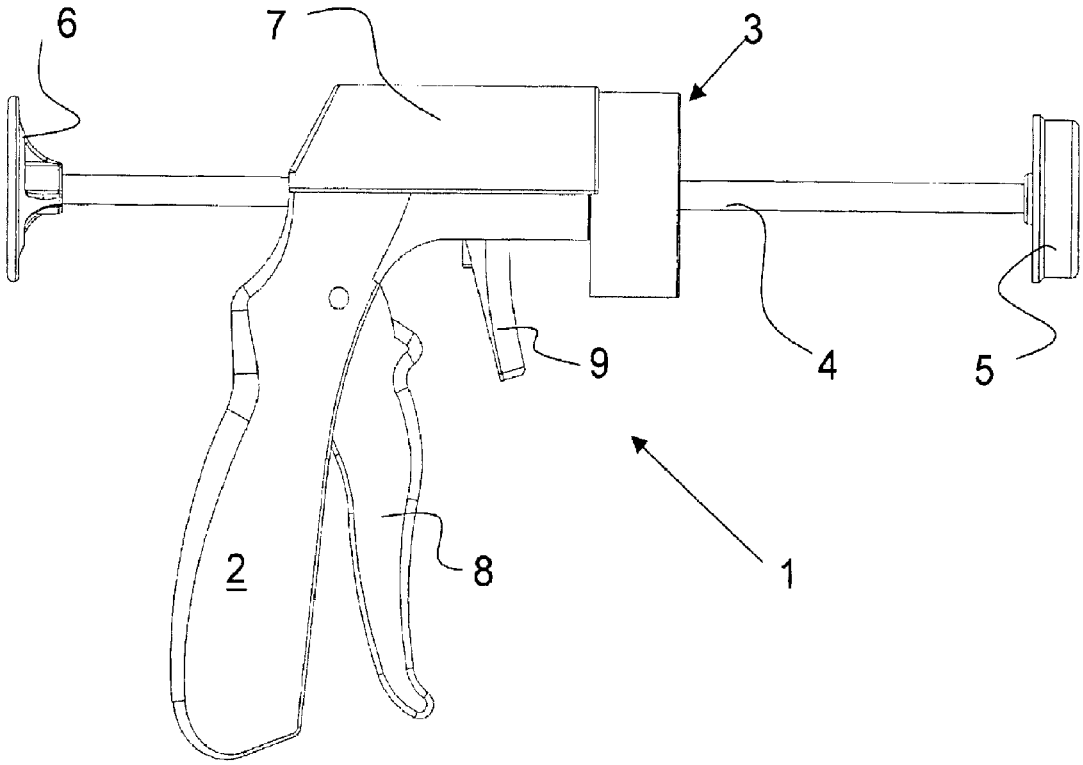
FIG. 1 shows a side view of an embodiment of a cartridge gun.

FIG. 1 shows a side view of an embodiment of a cartridge gun 1. The cartridge gun 1 comprises a housing 7, a grip 2, and a cartridge holder 3. The housing 7 comprises a piston rod 4, and an advancement and retraction device for displacing the piston rod 4 is arranged in the housing 7, and the device can be actuated by way of a pressure or advancement trigger 8. The piston rod 4 is moved forward a short step towards the front of the cartridge gun 1 with each pressure movement on advancement trigger 8, and it is moved a short step backward towards the rear of the cartridge gun 1 following a pressure movement of a retraction trigger 9. The term "front" refers to the area where cartridge holder 3 is arranged on cartridge gun 1, as shown in the accompanying figures, and the term "rear" refers to the opposite end of the "front" of cartridge gun 1. The piston rod 4 comprises a stamp 5 at its front end and the rear end of the piston rod 4 is provided with a holding knob 6. The holding knob 6 can be used to withdraw the piston rod 4 or it can be used to push into the cartridge up to the cartridge floor.

Figure 2:
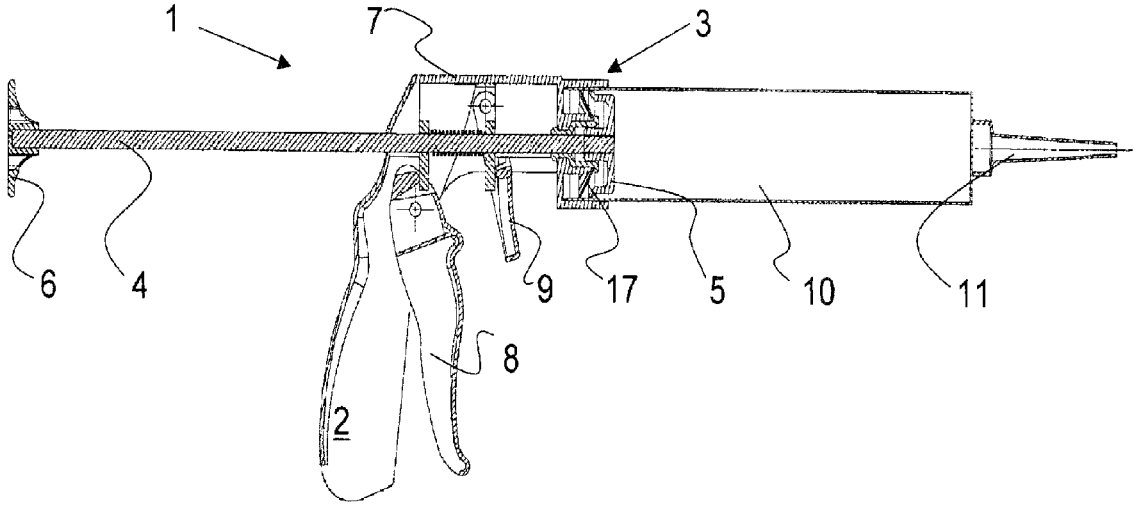
FIG. 2 shows a cross-sectional side view of the cartridge gun shown in FIG. 1, with an inserted cartridge.

FIG. 2 shows a cross-sectional view of the cartridge gun 1 shown in FIG. 1, with a cartridge 10 inserted into the cartridge holder 3. The cartridge 10 is shown without any content and without the cartridge floor which forms the piston. In the embodiment shown in FIG. 2, the piston rod 4 has been fully withdrawn. With each pressure movement on the advancement lever 8 in the direction towards the grip 2, the piston rod 4 is pressed slightly forward into the cartridge 10 in the direction towards nozzle 11. During this process, the stamp 5 presses against the piston in the cartridge (not shown) and presses the pasty material situated in the cartridge 10 outwardly through the nozzle 11. A short pressure movement on the retraction lever 9 in the direction towards the grip 2 pushes the piston rod 4 a small step backwards towards the rear of the cartridge gun 1, whereupon the piston in the cartridge 10 is relieved and the pressure in the cartridge 10 is reduced. Subsequent dripping of any pasty material within the cartridge 10 can thus be avoided.

Figure 3:
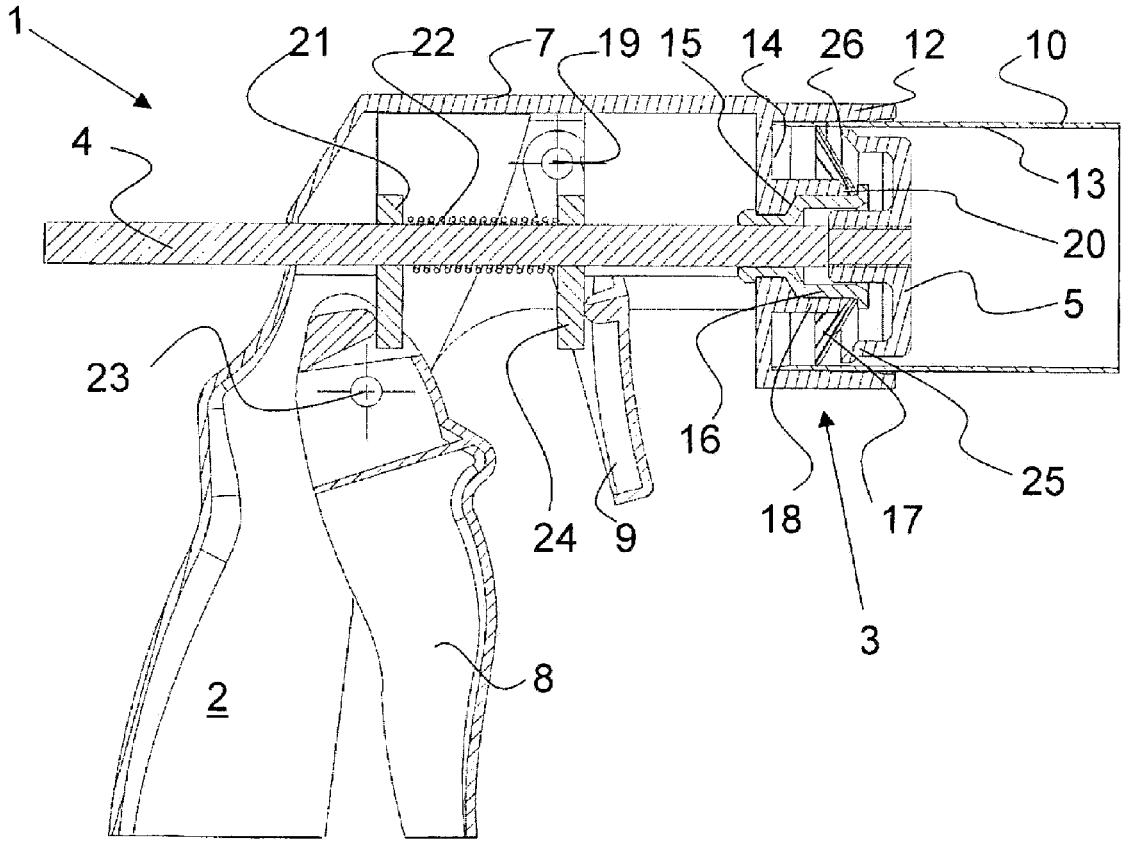
FIG. 3 shows a cross-sectional side view of the cartridge gun shown in FIG. 2, with an enlarged illustration of the cartridge holder and the actuating device for displacing the piston rod.

FIG. 3 shows an enlarged cross-sectional view of FIG. 2, illustrating the cartridge holder 3 and an actuating device arranged in housing 7 for displacing the piston rod 4. The cartridge holder 3 comprises a cylindrical base 12 with an annular groove 14. The outside diameter of the annular groove 14 corresponds to the outside diameter of cartridge 10, so that the cartridge 10 can be inserted effortlessly into the annular groove 14 of base 12, and rests on the outside wall of annular groove 14. An axially extending, graduated hole bore 15 in the center of base 12 is used for receiving a hub 16. A plurality of gripping elements 17 are clamped between the edge 20 of the collar 18, which is formed by the annular groove 14, hole bore 15, and hub 16. Said gripping elements 17 can be individual claws projecting into the annular groove 14, wherein free ends of gripping elements 17 reach up to the outside wall of annular groove 14. In the illustrated embodiment as shown in FIG. 3, the gripping elements 17 are formed by the jacket surface with longitudinal slots of an element in the shape of a truncated cone. The upper cover surface of the truncated element comprises a bore in such a way that the remaining circular ring of said cover surface can be clamped between hub 16 and the edge 20 of the collar 18. Strip-like gripping elements 17 are obtained by the slots in the jacket surface of the truncated element, wherein the free ends project into the annular groove 14 in the direction towards the housing 7 of the cartridge gun 1 up to the outside wall of the annular groove 14 and can be provided with a sharp edged or pointed configuration. In order to ensure sufficient stability and elasticity of the resilient gripping elements 17, gripping elements 17 are made of, but not limited to, spring steel and the like. Once a cartridge 10 is pressed into the base 12 of the cartridge holder 3, the gripping elements 17 press with their free ends against the inside wall 13 of the cartridge 10, wherein the cartridge 10 is securely held. As soon as stamp 5 is used to press against the piston in the cartridge 10, a pressure is also exerted on the cartridge 10, resulting in a pressing action of the cartridge 10 from the cartridge holder 3. This pressing action is prevented because the gripping elements 17 tightly grasp the side wall of the cartridge 10.

As shown in FIG. 3, a forward drive disk 21, which is tiltable, is attached to the housing 7, with the piston rod 4 projecting through its opening. The opening on the forward drive disk 21 is slightly larger than the diameter of the piston rod 4, so that the forward drive disk 21 is freely displaceable along the piston rod 4. The forward feed disk 21 is pressed to the back by the pressure spring 22. The grip 2 comprises an advancement trigger 8 which acts upon the lower side of the forward drive disk 21. As a result of actuating the advancement trigger 8, the forward drive disk 21 is tilted forwardly until it presses against the piston rod 4 and gets jammed, and it is further pressed forward against the pretension force of the pressure spring 22. It forwardly moves the piston rod 4 with the stamp 5. A further tiltable drive disk 24 for the rearward displacement of the piston rod 4 is attached to the housing 7. This retraction drive disk 24 is pressed forwardly by the pressure spring 22. A retraction trigger 9 which can be swiveled about an axis 19 is arranged in the housing 7 for the reverse displacement of the piston rod 4, which acts upon the lower side of the retraction drive disk 24. The retraction drive disk 24 is tilted in a rearward manner by actuating the retraction trigger 9 until it presses against the piston rod 4 and gets jammed, whereupon it is pushed further back against the pretension force of the pressure spring 22, whereby the piston rod 4 with the stamp 5 moves towards the rear of the cartridge gun 11.

In FIG. 3., the piston rod 4 and the cartridge 10 are shown in retracted positions. By pressing the advancement trigger 8, the piston rod 4 with the stamp 5 is pressed continuously in the forward direction into the cartridge 10 and against the piston of cartridge 10, whereby the material within the cartridge 10 are pressed and ejected from the cartridge 10. Once sufficient material has been ejected from cartridge 10, applying slight pressure or pulling on the retraction trigger 9 towards the rear of cartridge gun 1 is sufficient move the piston rod 4 slightly backwards or towards the rear of cartridge gun 1. As a result of pulling the retraction trigger 9, the pressure acting on the piston within the cartridge 10 by stamp 5 is substantially eliminated, and the excess pressure in cartridge 10 is reduced, thus preventing subsequent dripping of the material within the cartridge 10. The stamp 5 which is arranged at the front end of the piston rod 4 comprises a plane front surface and a rearwardly projecting edge 25 which is slightly sloped at its end 26. The sloping corresponds approximately to the inclination of the gripping elements 17. To remove or exchange an empty or used cartridge 10, the piston rod 4 is pushed towards the rear of the cartridge gun 1. This action can be achieved manually by pulling the piston rod 4 to the back on the knob 6 until the stamp 5 rests with its edge 26 on the gripping elements 17. The retraction of the piston rod 4 can also be achieved by actuating the retraction trigger 9 several times until the stamp 5 is fully retracted. To remove the cartridge 10 from the cartridge holder 3, the cartridge 10 is held by one hand of the user, while actuating the retraction trigger 9 by the other hand. This action causes the sloping end 26 of the edge 26 of stamp 5 to press against the resilient gripping elements 17, which are pressed away from the inside wall 13 of the cartridge 10, and the cartridge 10 can be removed from the cartridge holder 3. As soon as the stamp 5 has been pushed in a forward direction towards the front of the cartridge gun 1 again, the resilient gripping elements 17 return to their initial position as a result of their elasticity, which means that the free ends of the gripping elements 17 reach up to the inner edge of the circular groove 14 again.

Figure 4:
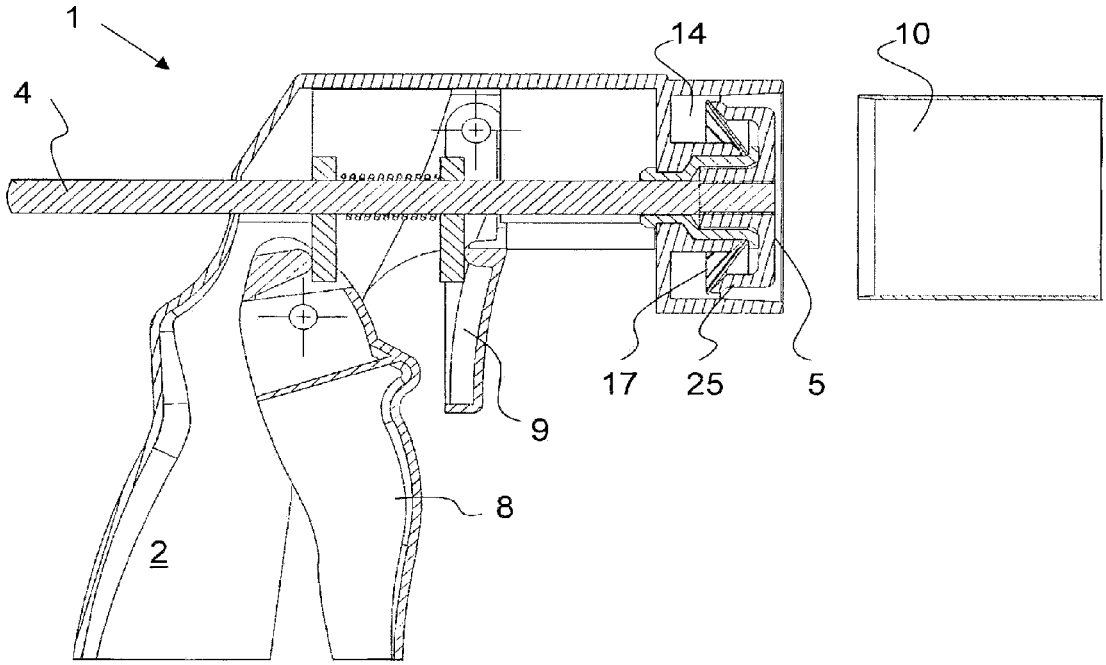
FIG. 4 shows cross-sectional side view of the cartridge gun shown in FIG. 2, with an enlarged illustration of the cartridge holder, the actuating device for displacing the piston rod, and a completely retracted stamp.

FIG. 4 shows an enlarged cross-sectional view of the housing 7 with the cartridge holder 3 and the actuating device for displacing the piston rod 4 when the stamp 5 is fully retracted. FIG. 4 further shows the retraction trigger 9 in a pressed position and the gripping elements 17 are pressed from the rearward projecting edge 25 of the stamp 5 against the inside, thus releasing the boundary region of the annular groove 14, as a result, the cartridge 10 can be withdrawn from the cartridge holder 3.

The embodiments shown in FIGS. 1-4 illustrate cartridge gun 1 in which the housing 7, the grip 2, and the cartridge holder 3 is of an integral configuration and may be, made of plastic, for example. In another embodiment, cartridge gun 1 includes individual parts and the base 12 of the cartridge holder 3 is screwed onto the face side of the housing 7.

While certain embodiments of the present invention have been described, it will be understood that various changes may be made in the above invention without departing from the scope of the invention. It is intended that all matter contained in the above description or shown in the accompanying drawings shall be interpreted as illustrative and not in a limiting sense.

REFERENCE NUMERALS

1 Cartridge gun
2 Grip
3 Cartridge holder
4 Piston rod
5 Stamp
6 Knob at the end of the piston rod
7 Housing of the cartridge gun
8 Advancement trigger
9 Retraction trigger
10 Cartridge
11 Nozzle
12 Cylindrical base
13 Inside wall of cartridge
14 Annular groove
15 Graduated hole bore
16 Hub
17 Gripping element (gripper)
18 Collar adjacent to hub
19 Axis lever 9
20 Edge of collar adjacent to hub
21 Forward drive disk
22 Pressure spring
23 Axis lever 8
24 Retraction drive disk
25 Collar on stamp
26 Incline of collar 25

The invention claimed is:

1. A cartridge gun, comprising:
(a) a housing;
(b) a grip connected to the housing;
(c) a cartridge holder connected to the housing and comprising a cylindrical base for receiving a floor region of a cartridge;
(d) a plurality of resilient gripping elements integrated with the cartridge holder;
(e) a displaceable piston rod that passes through the housing;
(f) an actuating device for displacing the piston rod; and
(g) a stamp provided on a front end of the piston rod, the stamp being displaceable in both a forward direction and a backward direction, wherein the gripping elements project radially outwardly from a center of the cartridge holder in a direction towards the housing into an annular groove provided in the base of the cartridge holder up to an outside wall of the annular groove and are held in the center of the base by means of a hub, and wherein the stamp presses ends of the gripping elements in the direction towards the housing when the piston rod is displaced backwards into a fully retracted position.

2. The cartridge gun of claim 1, wherein the gripping elements are made of spring steel.

3. The cartridge gun of claim 1, wherein the stamp comprises a backwardly projecting edge.

4. The cartridge gun of claim 1, wherein the actuating device comprises a tiltable forward drive disk and a tiltable retraction drive disk, wherein the grip comprises an advancement trigger, and wherein the housing comprises a retraction trigger.

5. The cartridge gun of claim 1, wherein the cylindrical base is formed integrally with the housing.

6. The cartridge gun of claim 1, wherein the housing, the grip, and the base are made of plastic.

7. The cartridge gun of claim 1, wherein the gripping elements are formed from an element shaped as a truncated cone, the element comprising:
(a) a jacket surface comprising recesses whereby individual resilient gripping elements are formed which can be moved independently from one another; and (b) a bore provided in an upper cover surface of the truncated element, whereby a remaining circular ring of the cover surface can be fastened in the center of the base by means of the hub.

8. A cartridge gun comprising:

(a) a housing comprising a retraction trigger;

(b) a grip connected to the housing, wherein the grip comprises an advancement trigger;

(c) a cartridge holder connected to the housing and comprising a cylindrical base for receiving a floor region of a cartridge;

(d) a plurality of resilient gripping elements integrated with the cartridge holder that project radially outward from a center of the cartridge holder in a direction towards the housing into an annular groove provided in the base of the cartridge holder up to an outside wall of the annular groove, wherein the gripping elements are held in the center of the base by means of a hub;

(e) a displaceable piston rod that passes through the housing;

(f) an actuating device for displacing the piston rod, wherein the actuating device comprises a tiltable forward drive disk and a tiltable retraction drive disk; and (g) a stamp arranged at a front end of the piston rod, wherein the stamp presses the ends of the gripping elements in the direction towards the housing when the piston rod is fully retracted.

9. The cartridge gun of claim 8, wherein the tillable forward drive disk and the tiltable retraction drive disk each comprise an opening through which the piston rod projects, wherein the openings are slightly larger than the diameter of the piston rod such that the forward and retraction drive disks are freely displaceable along the piston rod, wherein the cartridge gun further comprises a pressure spring arranged between the forward and retraction drive disks, whereby the pressure spring presses the forward drive disk towards the rear of the cartridge gun and presses the retraction drive disk towards the front of the cartridge gun, wherein the advancement trigger acts upon the bottom side of the forward drive disk and the retraction trigger acts upon the lower side of the retraction drive disk, whereby actuating the advancement trigger causes the forward drive disk to tilt forwardly and become jammed so that the piston rod can be displaced forwardly against the pretension force of the pressure spring, and whereby actuating the retraction trigger causes the retraction drive disk to tilt backwardly and become jammed so that the piston rod is displaceable backwardly against the pretension force of the pressure spring.

10. The cartridge gun of claim 8, wherein the gripping elements are made of spring steel.

11. The cartridge gun of claim 8, wherein the cylindrical base is formed integrally with the housing.

12. The cartridge gun of claim 8, wherein the housing, the grip, and the base are made of plastic.

* * * * *